US006080048A

United States Patent [19]

Kotagiri et al.

[11] Patent Number: 6,080,048

[45] Date of Patent: Jun. 27, 2000

[54] POLISHING MACHINE

[75] Inventors: Fuminari Kotagiri; Yoshio Nakamura; Yasuhide Denda; Haruo Sumizawa; Atsushi Kajikura; Satoki Kanda, all of Nagano, Japan

[73] Assignee: Fujikoshi Kikai Kogyo Kabushiki, Nagano, Japan

[21] Appl. No.: 09/114,823

[22] Filed: Jul. 14, 1998

[30] Foreign Application Priority Data

Mar. 6, 1998 [JP] Japan ..... 10-055338

[51] Int. Cl.[7] ..... B24B 5/00

[52] U.S. Cl. ..... 451/285

[58] Field of Search ..... 451/262, 264–266, 451/268–269, 285

[56] References Cited

U.S. PATENT DOCUMENTS 3,992,820 11/1976 Suter ..... 451/269

5,121,572 6/1992 Hilscher ..... 451/262 X

FOREIGN PATENT DOCUMENTS 344002277 1/1969 Japan ..... 451/269

*Primary Examiner*—David A. Scherbel
*Assistant Examiner*—Anthony Ojini
*Attorney, Agent, or Firm*—Jordan and Hamburg LLP

[57] ABSTRACT

The polishing machine of the present invention is capable of improving flatness of work pieces. In the polishing machine, a carrier is formed into a thin plate having a through-hole in which a work piece is accommodated. An upper polishing plate polishes an upper face of the work piece. A lower polishing plate pinches the work piece with the upper polishing plate and polishes a lower face of the work piece. A driving mechanism moves the carrier along a circular orbit in a plane without revolving. With this structure, the upper and lower faces of the work piece, which has been pinched between the polishing plates, are polished by the polishing plates.

11 Claims, 10 Drawing Sheets

POLISHING MACHINE

BACKGROUND OF THE INVENTION

The present invention relates to a polishing machine, more precisely relates to a polishing machine capable of polishing both sides (faces) of work pieces.

In a conventional polishing machine, an external gear and an internal gear are rotated at different angular velocity, so that a carrier revolves and moves round along an orbit as a planet gear. An upper polishing plate and a lower polishing plate, which are respectively provided on an upper and a lower sides of the carrier, pinch and polish work pieces, which are held in the carrier. This structure has been employed not only in polishing machines but also lapping machines. By employing this structure, both sides of the work pieces can be highly precisely polished in a short time. So the machines are properly used for polishing thin work pieces, e.g., silicon wafers for semiconductor chips.

The conventional polishing machine will be explained with reference to FIG. 10.

Polishing cloths are provided on surfaces of an upper polishing plate 112 and a lower polishing plate 114 to form polishing faces. An external gear 116 and an internal gear 118 are provided. Each carrier 120 has through-holes 121, in which work pieces 121 are respectively accommodated. The carriers 120 are engaged with the internal gear 118 and the external gear 116 as a planet gear, so that the carrier 120 are rotated.

The upper polishing plate 112 is connected to a rotary head 112*a*. A gear 112*c* is fixed to a lower end of a shaft 112*b*, which is downwardly extended from the rotary head 112. The gear 112*c* is engaged with a gear 112*d*; the gear 112*d* is engaged with a gear 112*e*. The gear 112*e* is coaxially fixed to a spindle 126, so that the gear 112*e* is rotated together with the spindle 126. A gear 114*a*, which is coaxially provided to the lower polishing plate 114, is engaged with a gear 114*b*, which is coaxially fixed to the spindle 126. The internal gear 118 is linked with a gear 118*b*, which is coaxially fixed to the spindle 126, by a gear 118*a*, which is coaxially provided to the internal gear 118. With this structure, the external gear 116, internal gear 118 and the polishing plates 112 and 114 are rotated by a four-way system including one driving unit.

The spindle 126 is connected to an adjustable reduction gear unit 132. The adjustable reduction gear unit 132 is connected to a motor 134 by a belt 136, so that rotational speed of the spindle 126 can be adjusted.

In the conventional polishing machine, gear ratio between the gears 116*a* and 116*b* and gear ratio between the gears 118*a* and 118*b* are defined, for example, to make angular velocity of the internal gear 118 faster than that of the external gear 116. In this case, the carrier 112, which engages with the external gear 116 and the internal gear 118, moves round in the same direction as a rotational direction of the internal gear 118, e.g., the counterclockwise direction, and revolves in the clockwise direction. The lower polishing plate 114 rotates in the counterclockwise direction; the upper polishing plate 112 rotates in the clockwise direction due to the gear 112*d*.

Note that, the rotational direction, rotational speed, etc. of the carriers 120 may be adjusted by changing the angular velocity of the external gear 116 and the internal gear 118 according to polishing conditions.

To polish both sides (surfaces) of the work pieces 121, a liquid abrasive including polishing grains is supplied to the both surfaces to be polished, so that the both surfaces of the works 121 can be properly polished. In the case of polishing silicon wafers, an alkali liquid abrasive (slurry) is supplied to the surfaces of the silicon wafers.

The liquid abrasive is supplied to the work pieces through vertical through-holes of the upper polishing plate 112. The liquid abrasive is usually fallen onto the work pieces by a pump and the gravitational force. The liquid abrasive, which has been fallen from the through-holes, is supplied to the polishing face of the upper polishing plate 112 and upper faces of the work pieces 121. And, the liquid abrasive is further supplied to the polishing face of the lower polishing plate 114 and lower faces of the work pieces 121 via spaces between the adjacent carriers 120.

FIG. 11 is a plan view showing an arrangement of the carriers 120 in the polishing machine shown in FIG. 10. There are the spaces "A" between the adjacent carriers 120. The spaces "A" are formed in an inner part and an outer part, and they have enough area so that the liquid abrasive is properly supplied onto the upper face of the lower polishing plate 114. As described above, the liquid abrasive for polishing the both faces of the works 121 can be supplied, by a simple supplying means, from upper side.

In the conventional polishing machine, the liquid abrasive can be properly supplied, and complex movement of the carriers 120 can be executed, so the work pieces 121, e.g., silicon wafers, can be uniformly polished. Thus, the flatness of the polished work pieces can be improved. By simultaneously polishing the both faces of the work pieces 121, polishing efficiency can be increased.

However, in the conventional polishing machine, the carriers 120 move between the external gear 116 and the internal gear 118, so size of work pieces is limited. These days, silicon wafers having greater diameter are required, but the conventional polishing machine cannot be employed to polish the large silicon wafers. Namely, it is impossible to use large carriers, whose diameters are greater than radius of the polishing plates. And, the polishing faces of the polishing plates cannot be used efficiently.

Further, a complex gear mechanism is assembled in the conventional polishing machine, so it is very difficult to make the size of the machine bigger and manufacturing cost must be higher.

SUMMARY OF THE INVENTION

An object of the present invention is to provide a polishing machine, which is capable of improving flatness of polished work pieces.

Another object of the present invention is to provide a polishing machine, which is capable of polishing large work pieces with simple structure and reducing manufacturing cost.

To achieve the objects, the polishing machine of the present invention comprises:

- a carrier being formed into a thin plate, the carrier having a through-hole in which a work piece is accommodated;
- an upper polishing plate being provided on an upper side of the carrier, the upper polishing plate polishing an upper face of the work piece in the through-hole of the carrier;
- a lower polishing plate being provided on a lower side of the carrier, the lower polishing plate pinching the work piece with the upper polishing plate and polishing a lower face of the work piece; and a driving mechanism for moving the carrier along a circular orbit in a plane, which is parallel to upper and lower faces of the carrier, without revolving, whereby the upper and lower faces of the work piece, which has been pinched between the polishing plates, are polished by the polishing plates.

In the polishing machine of the present invention, the driving mechanism moves the carrier along the circular orbit in the plane, which is parallel to the upper and lower faces of the carrier, without revolving on its own axis. The work piece pinched between the upper and lower polishing plates is moved together with the carrier. Without revolving the carrier, all points in the carrier execute the same movement, so that the work piece can be uniformly polished and the polishing faces of the upper and lower polishing plates can beused efficiently. By efficiently using the polishing faces of the polishing plates, a large work piece can be polished. With above described simple structure, its manufacturing cost can be reduced.

In the polishing machine, the upper and lower polishing plates may be revolved on their own axes, which are perpendicular to the upper and lower faces of the carrier. With this structure, the work piece can be relatively complexly moved with respect to the polishing plates, so that polishing accuracy can be improved.

In the polishing machine, the driving mechanism may comprise:

a base member;

a carrier holder for holding the carrier;

a crank-shaped member including a first shaft, which is arranged perpendicular to the upper and lower faces of the carrier and whose one end is pivotably connected to the carrier holder, and a second shaft, which is arranged in parallel to the first shaft and whose one end is pivotably connected to the base member; and a rotating unit for rotating the second shaft of the crank-shaped member on its owen axis, whereby the first shaft of the crank-shaped member is moved round and the carrier holder is moved along a circular orbit without revolving. With this simple structure, the carrier, which is held by the carrier holder, can be moved with the circular orbit without revolving on its own axis.

In The polishing machine, a plurality of the crank-shaped members may be provided, and their second shafts may be mutually connected by a synchronizing mechanism, which synchronously moves the crank-shaped members. With this simple structure, the carrier can be properly and stably moved.

In the polishing machine, the driving mechanism may have a carrier holder for holding the carrier, and the carrier holder and the carrier may be connected by a connecting mechanism, which allows heat expansion of the carrier by a clearance. By allowing the heat expansion of the carrier, bending the carrier and breaking the work piece can be prevented. And, lowering of the polishing accuracy can be prevented.

In the polishing machine, the connecting mechanism may be a pin provided to the carrier holder, the pin may be loosely fitting in a hole, which is formed in the carrier and elongated in the direction of the heat expansion of the carrier. With this simple structure, the carrier can be properly connected to the carrier holder.

In the polishing machine, the upper polishing plate may have a feeding hole through which a liquid abrasive is fed to a polishing face of the upper polishing plate, which polishes the work piece, and the carrier may have a connecting hole through which the liquid abrasive, which has been fed through the feeding hole, is fed to a polishing face of the lower polishing plate, which polishes the work piece. With this simple structure, the liquid abrasive can be fully fed to the polishing faces, and the polishing efficiency and the polishing accuracy can be improved.

The polishing machine may further comprise a vibration restraining mechanism capable of contacting the upper polishing plate so as to restrain vibration of the upper polishing plate in the direction parallel to the upper and lower faces of the carrier. With this structure, large polishing plates can be properly employed.

In the polishing machine, the vibration restraining mechanism may be a plurality of guide rollers, which contact an outer circumferential face of the upper polishing plate. With this structure, the vibration restraining mechanism can be easily realized.

The polishing machine may further comprise:

a rotary shaft being arranged in the direction perpendicular to the upper and lower faces of the carrier, the rotary shaft being revolved on its own axis, one end of the rotary shaft being fixed to the upper polishing plate to suspend and revolve the upper polishing plate; and an elevating member holding the rotary shaft, the elevating member being capable of vertically moving together with the rotary shaft. With this structure, polishing faces of the upper polishing plate and the lower polishing plate are maintained parallel, and load of the upper polishing plate is uniformly applied to the work piece.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENT

Preferred embodiments of the present invention will now be described in detail with reference to the accompanying drawings.

Figure 1:
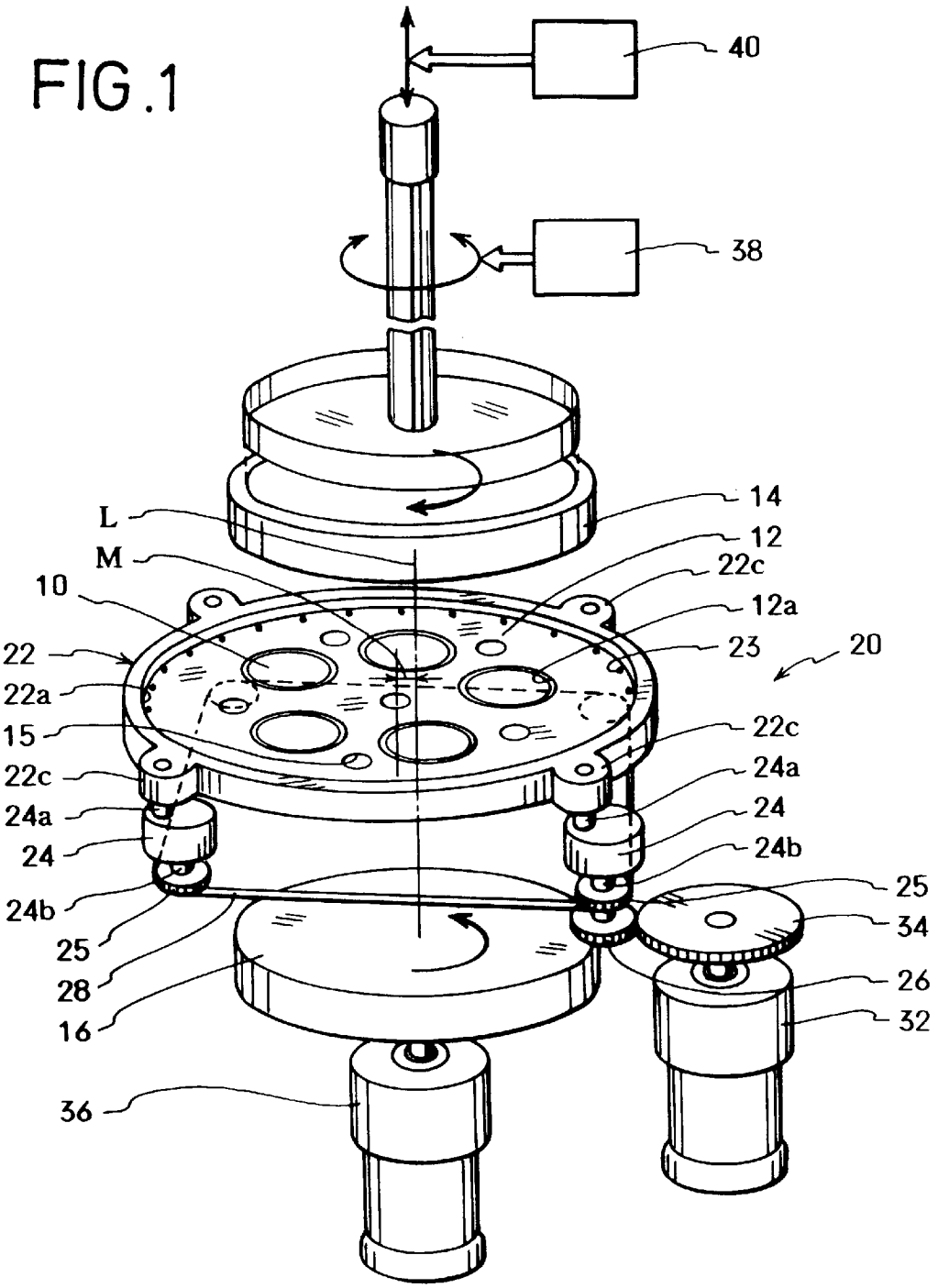
FIG. 1 is an exploded perspective view of a polishing machine of an embodiment of the present invention.
Figure 2:
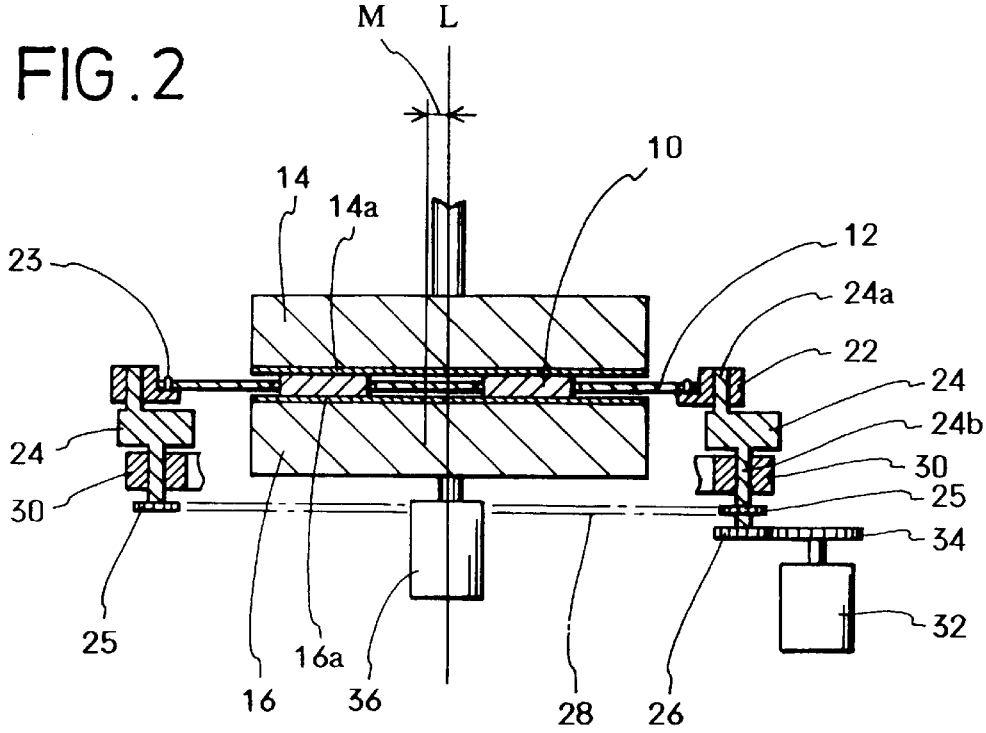
FIG. 2 is a sectional view of the polishing machine shown in FIG. 1.

FIG. 1 is the exploded perspective view of the polishing machine of the present embodiment; FIG. 2 is the sectional view of the polishing machine shown in FIG. 1.

In the present embodiment, plate-shaped work pieces 10 are silicon wafers 10. The polishing machine polishes the both sides (faces) of the wafers 10. The polishing machine comprises: a carrier 12 being formed into thin plates and having through-holes 12*a*; and an upper polishing plate 14 and a lower polishing plate 16 being capable of vertically pinching the wafers 10, which have been respectively accommodated in the through-hole 12*a* of the carrier 20, and polishing the both faces of the wafers 10. A polishing cloth 14*a* is provided on a lower face of the upper polishing plate 14; a polishing cloth 16*a* is provided on an upper face of the lower polishing plate 16. Surfaces of the polishing cloths 14*a* and 16*a* are polishing faces of the polishing plates 14 and 16. The polishing plates 14 and 16 are capable of revolving on their own axes, which are perpendicular to a plane including the carrier 12.

The wafers 10 are formed into circular discs and respectively accommodated in the circular through-holes 12*a*. The wafers 10 are capable of freely rotating in the through-holes 12*a*.

In the present embodiment, the carrier 12 is glass-epoxy plate. In the case of polishing the wafers 10 whose thickness is 0.8 mm, the thickness of the carrier 12 is usually designed about 0.7 mm.

A driving mechanism 20 moves the carrier 12 in a plane, which is parallel to upper and lower faces of the carrier 12, so that the wafers 10, which have been accommodated in the through-holes 12*a* and pinched between the polishing plates 14 and 16, are moved.

The driving mechanism 20 moves the carrier 12 along a circular orbit in a plane, which is parallel to upper and lower faces of the carrier 12, without revolving. The wafers 10 are pinched between the upper and the lower polishing plates 14 and 16 and moved therebetween. Namely, the carrier 12 are moved in the same plane without revolving on its own axis.

Next, details of the driving mechanism 20 will be explained.

Figure 4A:
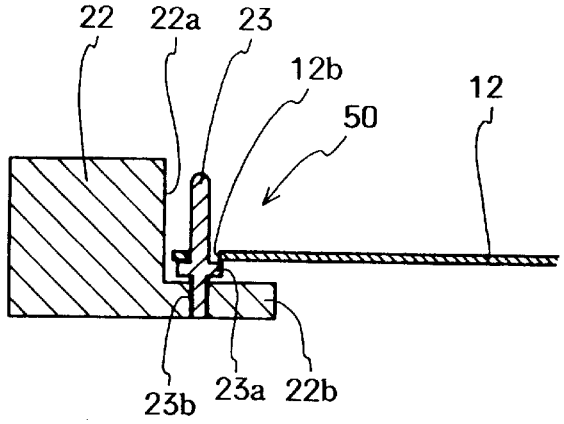
FIG. 4A is a partial sectional view of a connecting mechanism of the polishing machine.
Figure 4B:
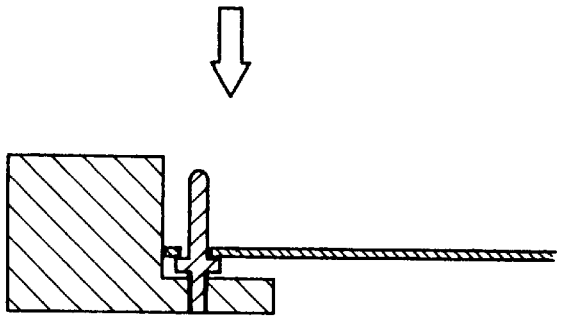
FIG. 4B is a partial sectional view of the connecting mechanism of the polishing machine.
Figure 3A:
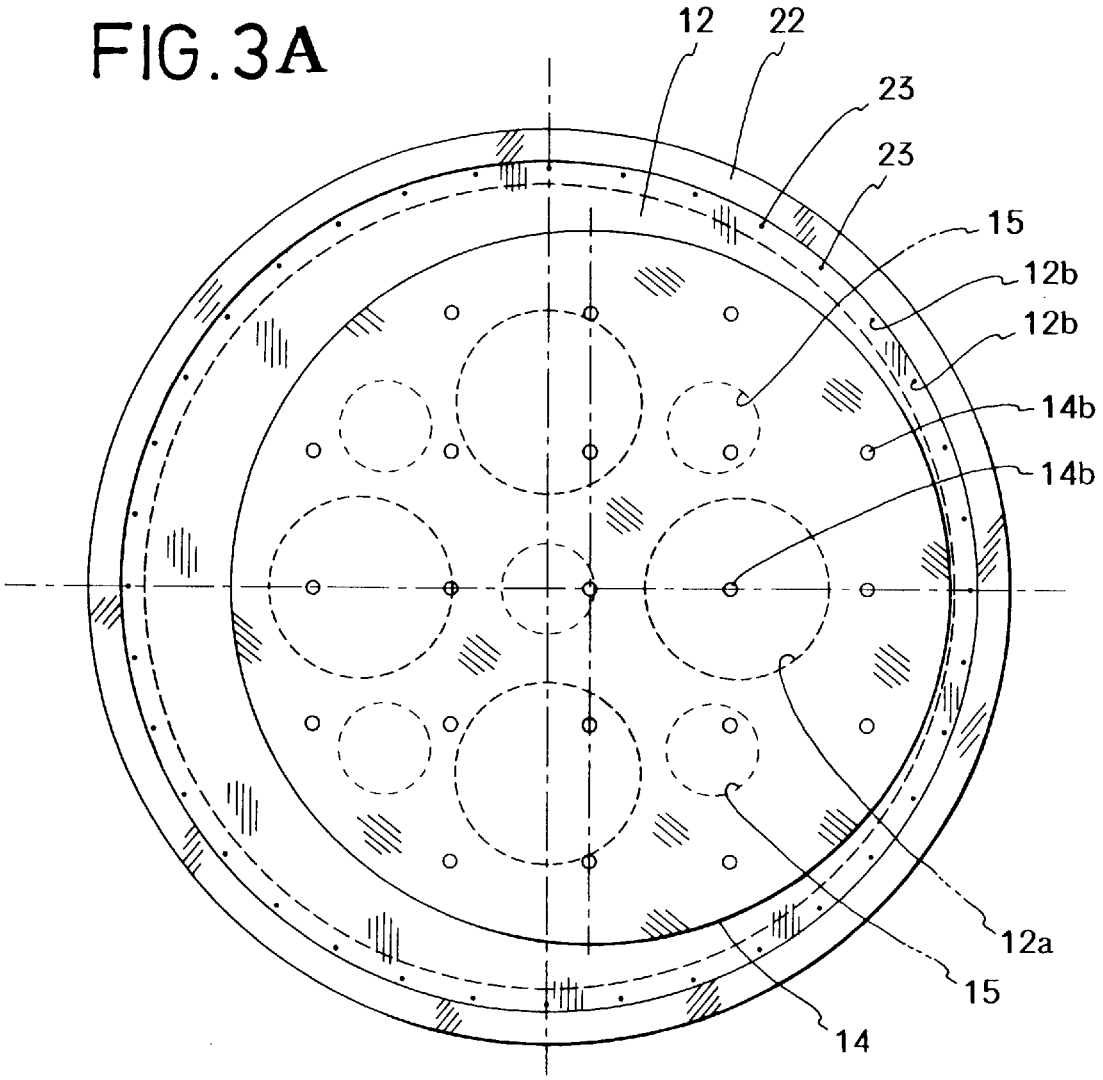
FIG. 3A is a plan view of a carrier holder of the polishing machine shown in FIG. 1.
Figure 3B:
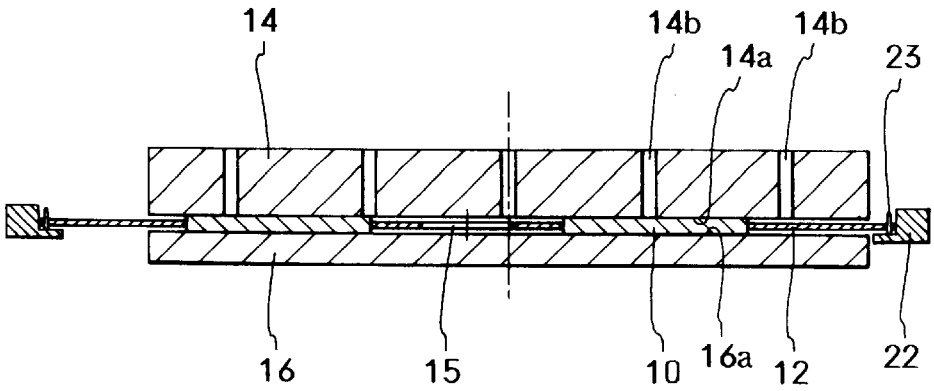
FIG. 3B is a sectional view of a carrier holder of the polishing machine shown in FIG. 1.

A ring-shaped carrier holder 22 holds the carrier 12. The carrier holder 22 and the carrier 12 are connected by a connecting mechanism 50. FIG. 3 A is the plan view showing the carrier holder 22 and the carrier 12; FIG. 3B is the sectional view showing the carrier holder 22 and the carrier 12; FIGS. 4A and 4B are the partial sectional views of the connecting mechanism 50.

The connecting mechanism 50 prohibits the revolution of the carrier 12 and allows heat expansion thereof.

As shown in FIGS. 4A and 4B, the connecting mechanism 50 comprises: a pin 23 provided to the carrier holder 22; and a hole 12*b* formed in the carrier 12. The pin 23 is capable of loosely fitting in the hole 12*b*. To allow the heat expansion of the carrier 12, the hole 12*b* is elongated in the direction of the heat expansion of the carrier, e.g., a radial direction of the carrier 12, so that a clearance of the hole 12*b* allows the heat expansion. In the present embodiment, a plurality of the long holes 12*b* are radially formed in the carrier 12.

There is formed a clearance between an inner circumferential face 22*a* of the carrier holder 22 and an outer circumferential face of the carrier 12 so as to allow the heat expansion of the carrier 12 in the radial direction. Namely, inner diameter of the carrier holder 22 is slightly greater than outer diameter of the carrier 12.

The carrier 12 is connected with the carrier holder 22 by loosely fitting the pins 23 of the carrier holder 22 into the clearances of the holes 12*b* of the carrier 12.

By the simple connecting mechanism 50 capable of allowing the heat expansion of the carrier 12, the carrier 12 are connected with the carrier holder 22 and prohibited to revolve on its own axis.

By allowing the heat expansion of the carrier 12, bending or deformation of the carrier 12 can be prevented. And, by employing the simple connecting mechanism 50, the carrier 12 can be easily attached to and detached from the carrier holder 22.

Next, a carrier height adjusting mechanism, which is provided to the carrier holder 22, will be explained.

A flange section 23*a* is provided to a mid part of the pin 23. The flange section 23*a* supports the carrier 12. A male screw section 23*b* is formed, below the flange section 23*a*, in the pin 23. The male screw section 23*b* is screwed in a lower step section 22*b* of the carrier holder 22. The height of the carrier 12 can be adjusted by changing the length of screwing the male screw section 23*b* in the lower step section 22*b*. By the flange sections 23*a* of the pins 23, the height of the carrier 12 can be properly adjusted.

Even if the polishing cloth 16*a* of the lower polishing plate 16 is abraded, the height of the carrier 12 can be adjusted by adjusting the height of the flange sections 23*a*, so that the carrier 12 can be properly supported by the lower polishing plate without deformation. Thus, the carrier can be horizontally supported, so that forming cracks in the wafers 10 and lowering of polishing accuracy can be prevented.

An outer edge of the carrier 12 is partially supported by upper faces of the flange sections 23*a*. Namely, contact area between the lower face of the carrier 12 and the upper faces of the flange sections 23*a* is small, so that friction among them can be reduced. Thus, the carrier 12 can properly slide on the flange sections 23*a* without deformation when the carrier 12 is expanded by the heat.

In the present embodiment, the height of the carrier 12 is adjusted by changing the height of the flange sections 23*a* of the pins 23. In the present invention, the carrier height adjusting mechanism is not limited to above described mechanism. Other mechanisms, which are capable of adjusting the height of the carrier 12, may be employed.

For example, a mechanism capable of vertically moving the carrier holder 22 may be employed. In this case, an upper face of the lower step section 22*b* of the carrier holder 22 may supports the carrier 12. To reduce friction between the lower face of the carrier 12 and the upper faces of the lower step section 22*b*, projected sections may be formed on the upper faces of the lower step section 22*b*.

Figure 5A:
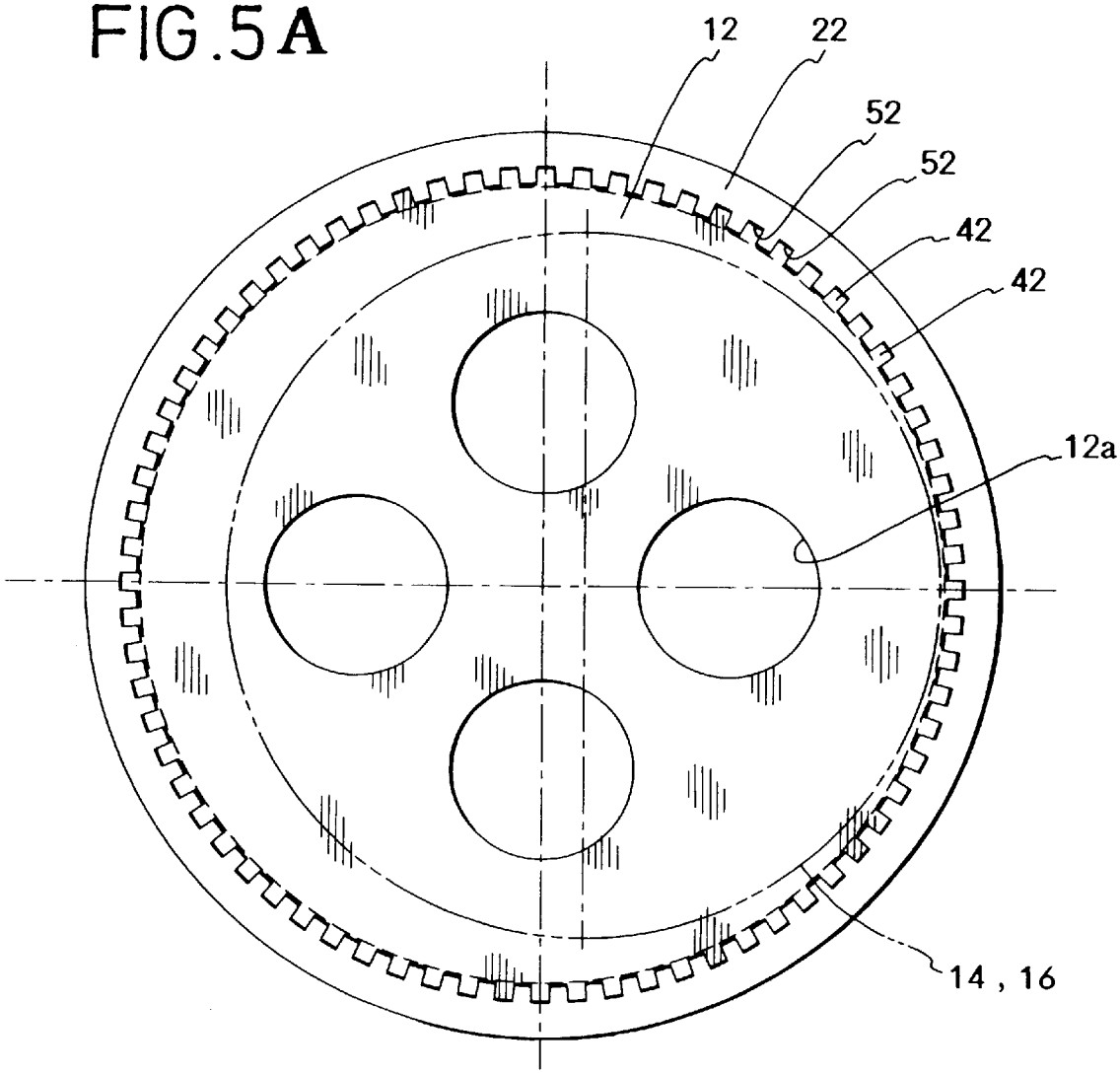
FIG. 5A is a plan view of another example of the connecting mechanism.
Figure 5B:
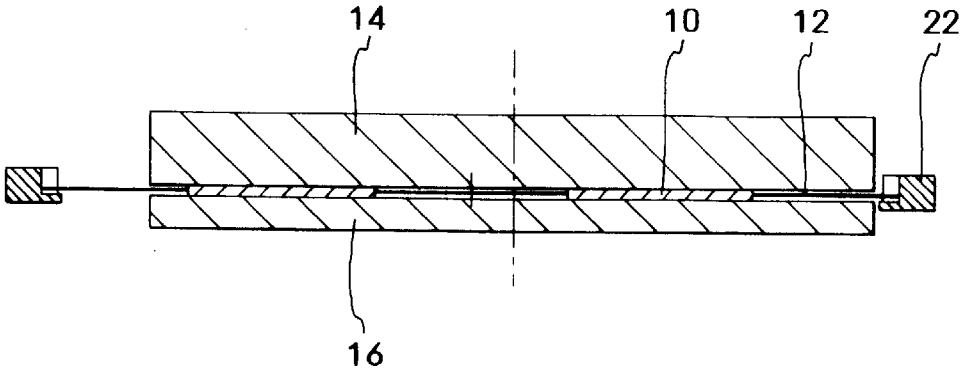
FIG. 5B is a sectional view of another example of the connecting mechanism.

Another example of the connecting mechanism will be explained with reference to FIGS. 5A and 5B. FIG. 5A is the plan view of the connecting mechanism; FIG. 5B is the sectional view thereof.

In the polishing machine shown in FIGS. 5A and 5B the connecting mechanism 50 is solely different from the foregoing embodiment. The connecting mechanism comprises: engaging sections 52 of the carrier holder 22 being formed on an inner circumferential face of the carrier holder 22 like an internal gear; and engaging sections 42 of the carrier 12 being formed on an outer circumferential face of the carrier 12 like an external gear and being loosely engaged with the engaging sections 52. Namely, the gears 42 formed on the outer circumferential face of the carrier 12 and the gears 52 of the carrier holder 52 are loosely engaged. With this simple structure too, the carrier 12 can be properly connected with the carrier holder 22. The effects are as same as the foregoing embodiment.

Details of the driving mechanism 20 will be explained with reference to FIGS. 1 and 2.

Figure 6:
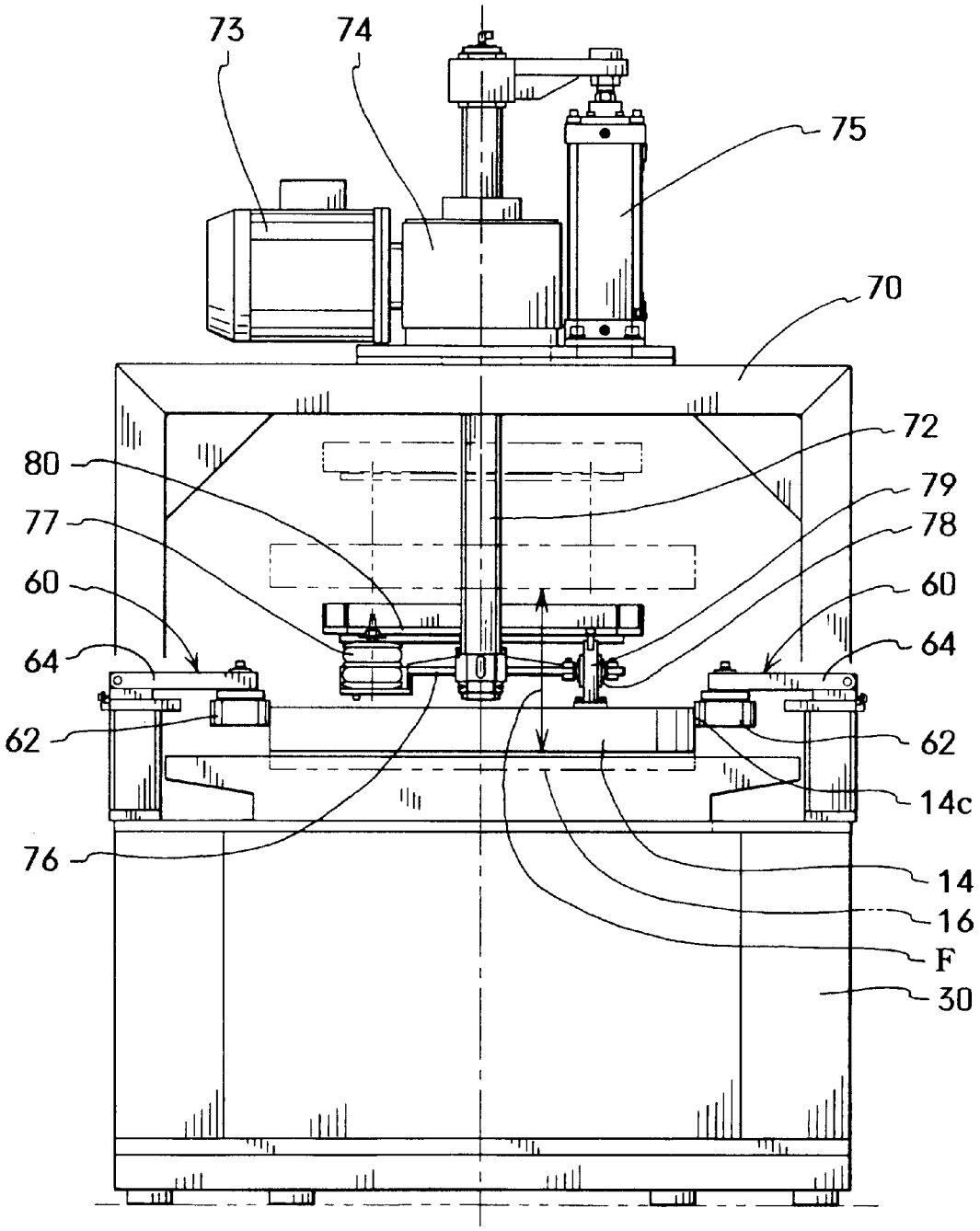
FIG. 6 is a front view of a vibration restraining mechanism of an upper polishing plate.

Each crank-shaped member 24 includes: a first shaft 24*a*, which is arranged parallel to an axial line "L" of the polishing plates 14 and 16, and whose upper end is pivotably connected to the carrier holder 22; and a second shaft 24*b*, which is arranged in parallel to the first shaft 24*a* and separated prescribed length "M" away there from, and whose lower end is pivotably connected to the base member 30 (see FIG. 6). Namely, the crank-shaped members 24 act as crank arms of a crank mechanism.

Four crank-shaped members 24 are provided between the carrier holder 24 and the base member 30, and they support the carrier holder 24 and rotate the second shafts 24*b* on their own axes. By rotating the second shafts 24*b*, the carrier holder 30 is moved round along a circular orbit, with respect to the base member 30, without revolving. The upper ends of the first shafts 24*a* are respectively pivotably fitted in bearing sections 22*c*, which are radially extended from an outer circumferential face of the carrier holder 22. With this structure, the carrier 12 can be moved round the axial line "L" of the polishing plates 14 and 16, along the circular orbit, without revolving on its own axis. Radius of the circular orbit is equal to the length "M", and all the points in the carrier 12 are moved round along circular orbits, whose radius is "M".

A timing chain 28 is engaged with four sprockets 25, which are respectively fixed to the second shafts 24*b* of the crank-shaped members 24. The timing chain 28 and the four sprockets 25 constitute the synchronizing mechanism for synchronously moving the four crank-shaped members 24 along their circular orbits. This simple synchronizing mechanism is capable of stably moving the carrier 12. The polishing accuracy can be improved, and the flatness of the polished wafers 10 can be improved. Note that, the synchronizing mechanism is not limited to above described constitution, other synchronizing means, e.g., timing belt and timing pulleys, gears, may be employed.

An output gear 34 is fixed to an output shaft of a motor 32. The output gear 34 is engaged with a gear 26, which is fixed to one of the second shafts 24*b*. The motor 32, the output gear 34 and the gear 26 constitute the rotating unit for rotating the second shafts 24*b*.

Note that, a plurality of electric motors, each of which rotates each second shaft 24*b*, for example, may be employed as the rotating unit. In the case of the electric motors, the crank-shaped members 24 can be electrically synchronized, so that the carrier 12 can be smoothly moved by synchronizing the movement of the crank-shaped members 24.

In the present embodiment, four crank-shaped members 24 are employed, but the number of the crank-shaped members 24 is not limited to four. To stably support and smoothly move the carrier holder 22, preferable number of the crank-shaped members 24 is three or more.

The carrier holder 22 may be moved in the plane by an X-Y table. If a couple of shafts of the X-Y table, which are crossed at right angle, are pierced through the carrier holder 22 or another member to which the carrier holder 22 is attached, the carrier holder 22 can be moved round, without revolving, by one crank-shaped member 24.

The X-Y table may have a driving mechanism without the crank-shaped member 24. The shafts of the X-Y table may be moved in the X- and the Y-directions by a proper mechanism or mechanisms, e.g., ball screws and servo motors, timing chains and servo motors. By moving the shafts in the X- and the Y-directions, the carrier holder 22 can be mover round without revolving. In this case, two motors are required. By controlling the motors, many types of two dimensional movement of the carrier holder 22 can be realized, and the movement can be applied to polish the wafers 10.

A motor 36 rotates the lower polishing plate 16. The output shaft of the motor 36 is connected to a shaft of the lower polishing plate 16.

On the other hand, the upper polishing plate 14 is rotated by a rotating means 38.

The motor 36 for rotating the lower polishing plate 16 and the rotating means 38 for rotating the upper polishing plate 14 are optionally controlled, so that rotational speed and rotational directions of the polishing plates 14 and 16 can be optionally changed, so that many types of polishing can be realized.

As shown in FIG. 2, the wafers 10, which have been respectively accommodated in the through-holes 12*a* of the carrier 12, are pinched and polished between the polishing plates 14 and 16. A press mechanism (see FIGS. 6 and 8) applies force for pinching the wafers 10 to the upper polishing plate 14. An air-bag or air-bags, for example, may be employed as the press mechanism. In this case, the maximum pinching force is equal to the weight of the upper polishing plate 14, and the pinching force applying to the upper polishing plate 14 can be adjusted by changing inner air pressure of the air-bag. By employing the air-bag, the pinching force can be properly adjusted. Note that, a lifting unit 40 vertically moves the upper polishing plate 14. The lifting unit 40 moves the upper polishing plate 14 upward when the wafers 10 are set in and taken out from the carrier 12.

Next, means for supplying the liquid abrasive (slurry) will be explained with reference to FIGS. 1, 3A and 3B.

There are bored a plurality of feeding holes 14*b*, through which the slurry can be introduced to the polishing face 14*a* of the upper polishing plate 14, which polishes the upper faces of the wafers 10.

The feeding holes 14*b* must fully and uniformly introduce the slurry to the polishing face 14, but the size, shapes and number of the feeding holes 14*b* are not limited. In the present embodiment, 21 feeding holes 14*b* are metrically bored in the upper polishing plate 14 so as to uniformly supply the slurry. The feeding holes 14*b* are small holes. Note that, the feeding holes 14*b* are vertical through-holes in the upper polishing plate 14.

Tubes (not shown) are connected to upper ends of the feeding holes 14*b*, and the slurry, which is exerted by a pump, is introduced to the feeding holes 14*b* via the tubes.

The carrier 12 has connecting holes 15 through which the slurry, which has been fed through the feeding holes 14*a*, is fed to the polishing face 16*a* of the lower polishing plate 16, which polishes the wafers 10.

Positions and size of the connecting holes 15 are designed so as not to weaken the carrier 12. Number, size and shape of the connecting holes 15 are not limited. In the embodiment shown in FIG. 3, there are bored five circular connecting holes 15 at the center of the carrier 12 and positions between the adjacent through-holes 12*a*.

In the carrier 12, the slurry can be properly fed or supplied to the both faces of the wafers 10, so the both faces can be properly polished. Namely, the slurry is fully introduced to the lower faces of the wafers 10 via the connecting through-holes 15. Thus, the both faces of the wafers 10 can be uniformly polished with high polishing accuracy.

Surplus slurry outwardly overflows from the polishing face 16*a*, and the overflowed slurry is collected and circulated to reuse.

Figure 7:
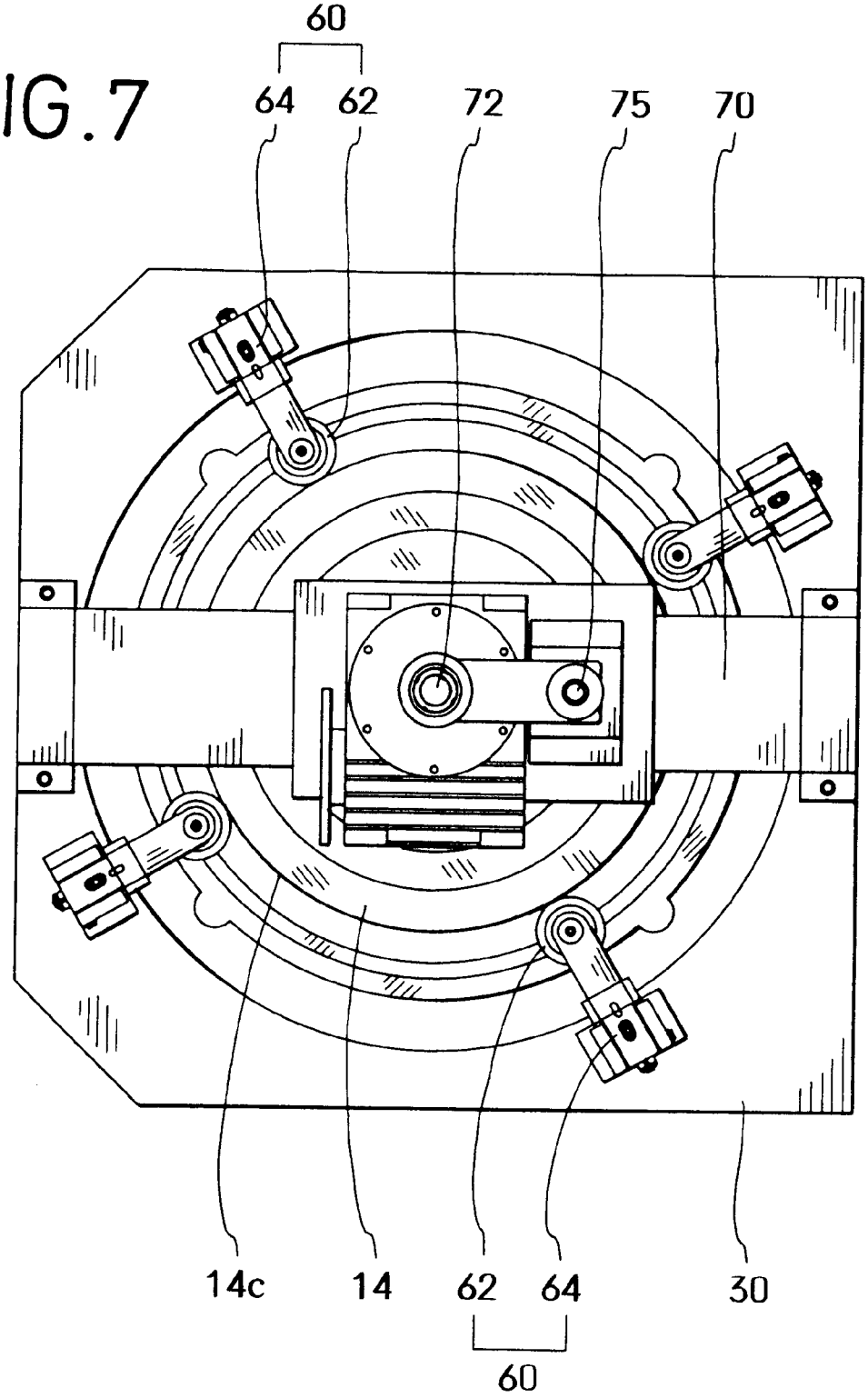
FIG. 7 is a plan view of the vibration restraining mechanism shown in FIG. 6.
Figure 8:
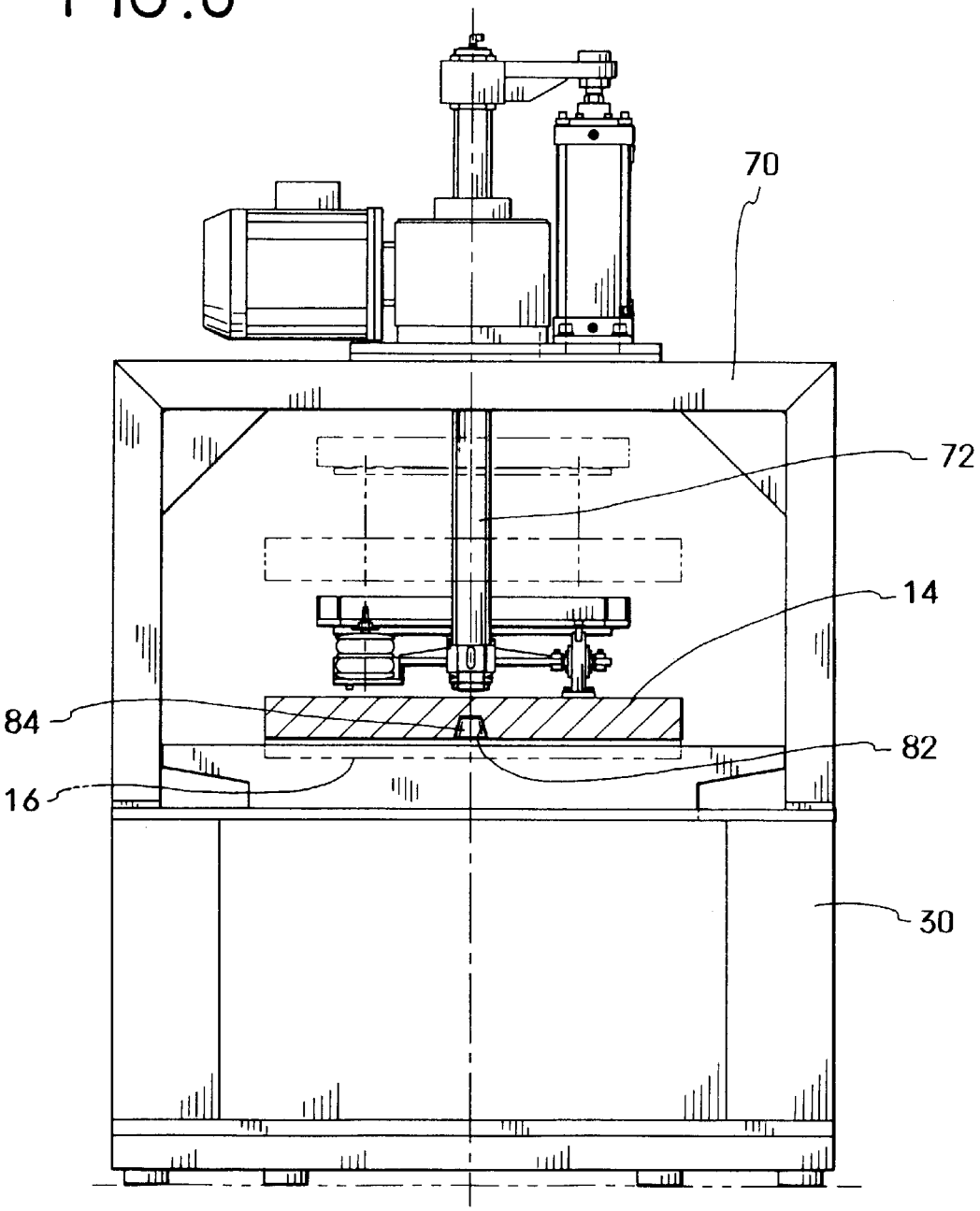
FIG. 8 is a front view of another example of the vibration restraining mechanism.

Successively, the vibration restraining mechanism will be explained with reference to FIGS. 6–8.

In FIGS. 6 (the front view) and 7 (the plan view), the vibration restraining mechanism includes a plurality of rollers 62. The rollers 62 contact the upper polishing plate 14 so as to prevent horizontal vibration of the upper polishing plate 14.

Each guide rollers 60 has: a base section 64; and the roller 62, which is attached to the base section 64 and capable of rotating on its vertical axis. The guide rollers 60 are fixed to the base member 30, and the rollers 62 contact an outer circumferential face 14*c* of the upper polishing plate 14. Since the upper polishing plate 14 is pinched by the guide rollers 60 while polishing the wafers 10, the horizontal movement of the upper polishing plate 14 is prohibited, so that the horizontal vibration of the upper polishing plate 14 can be prevented.

In the present embodiment, four guide rollers 60 are provided, but preferred number of the guide rollers 60 is three or more.

The vibration restraining mechanism is advantageous in the case of employing a large upper polishing plate. And, polishing efficiency can be improved by the vibration restraining mechanism.

In the present embodiment, the carrier 12 is capable of independently moving between the polishing plates 14 and 16. So the upper polishing plate 14 is rotatably suspended by a vertical shaft. A mechanism for suspending the upper polishing plate 14 has: a gate-shaped frame section 70; and a vertical spline shaft 72, which is rotatably attached to the frame section 70.

A motor 73 rotates the upper polishing plate 14 with a reduction gear unit 74 and the spline shaft 72. A cylinder unit 75 is capable of vertically moving the upper polishing plate 14, in the direction "F" shown in FIG. 6, with the spline shaft 72. A plate 76 is fixed to a lower end of the spline shaft 72. lower ends of the air-bags 77 and bearings 78, which are capable of swingably holding suspending shafts 79, are fixed to the plate 76. Upper ends of the air-bags 77 and upper ends of the suspending shafts 79, whose lower ends are fixed to the upper polishing plate 14, are fixed to a movable plate 80. When the inner pressure of the air-bags 77 are increased, the upper polishing plate 14 is moved upward, and the bearings 78 allow the polishing face of the upper polishing plate 14 to incline and make parallel to the polishing face of the lower polishing plate 16.

To vertically move the upper polishing plate 14, the spline shaft 72 should be long. So the upper polishing plate 14 is apt to vibrate horizontally. The upper polishing plate 14 revolves on its own axis, but the carrier 12 is moved round along the circular orbit without revolving on its own axis, so frictional force generates between the upper polishing plate 14 and the wafers 10, which are moved together with the carrier 12. The frictional force makes the upper polishing plate 14 vibrate horizontally. If the spline shaft 72 is long, the upper polishing plate 14 is apt to vibrate. And, in the case of large and heavy upper polishing plate 14, the number of specific vibrations of suspended parts including the upper polishing plate 14 is low, so that the upper polishing plate 14 is further apt to vibrate. Further, if the rotational speed of the upper polishing plate 14 is too fast, the upper polishing plate 14 vibrates sympathetically and the wafers 10 are broken.

By employing the vibration restraining mechanism of the present embodiment, the vibration of the upper polishing plate 14 can be prevented. Namely, a large and heavy polishing plates can be employed and the rotational speed of the polishing plates can be faster, so that the polishing efficiency of the polishing machine can be improved.

Another example of the vibration restraining mechanism of the upper polishing plate 14 will be explained with reference to FIG. 8.

There is formed a tapered cavity 82 in the center of the lower face of the upper polishing plate 14; there is formed a tapered projection 84 in the center of the upper face of the lower polishing plate 16. There is bored a through-hole, through which the projection 84 passes, in the carrie 12.

When the wafers 10 are polished, the projection 84 is fitted in the cavity 82. By fitting the projection 84 in the cavity 82, the vibration of the upper polishing plate 14 can be prevented. A bearing for smoothly rotating the projection 84 in the cavity 82 may be provided in the cavity 82. With this simple structure, the vibration can be prevented.

Besides above described vibration restraining mechanisms, other means can be employed. For example, fixed members having slidable faces may be used instead of the guide rollers 62. And, rollers may be provided to the upper polishing plate 14 and a ring guide, in which the rollers of the upper polishing plate 14 roll on an inner circumferential face, may be fixed to the base member 30. Further, the cavity 82 may be formed in the lower polishing plate 16, and the projection 84 may be formed in the upper polishing plate 14.

Figure 9A:
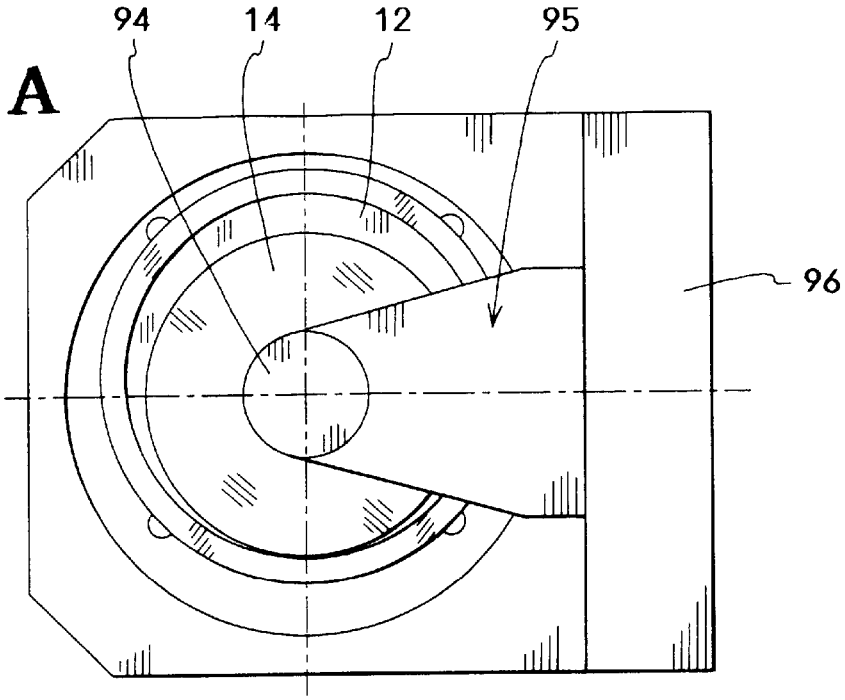
FIG. 9A is a plan view of a load restraining mechanism.
Figure 9B:
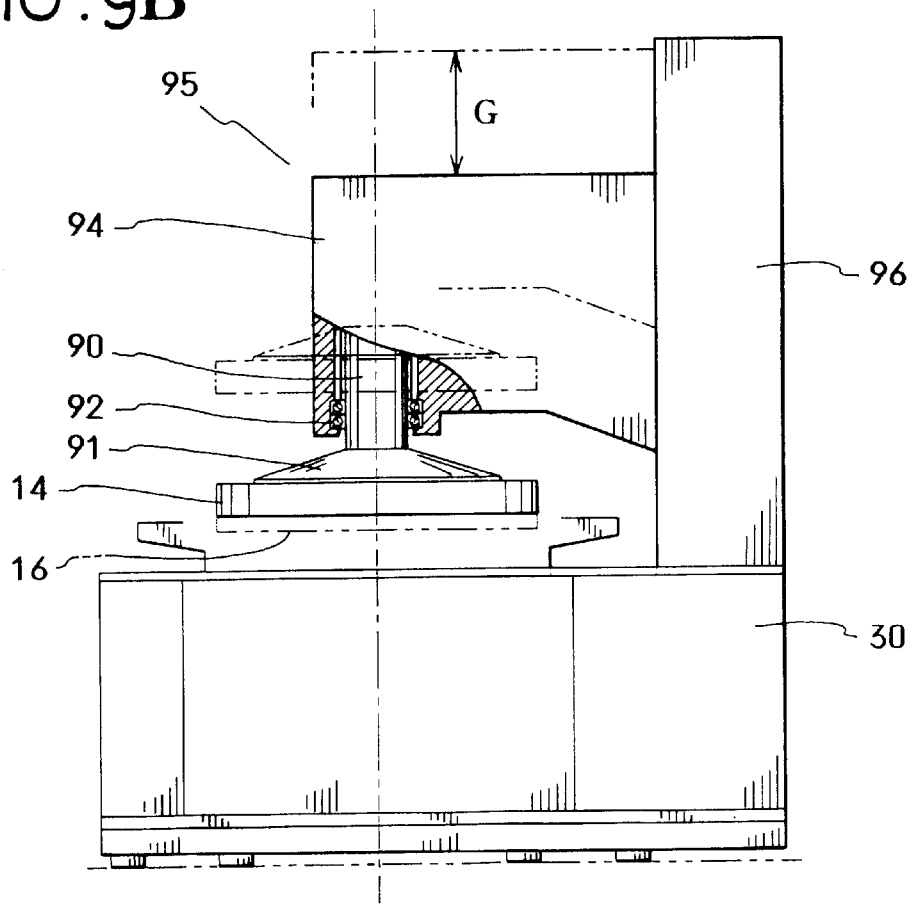
FIG. 9B is a side view of the load restraining mechanism.
Figure 10:
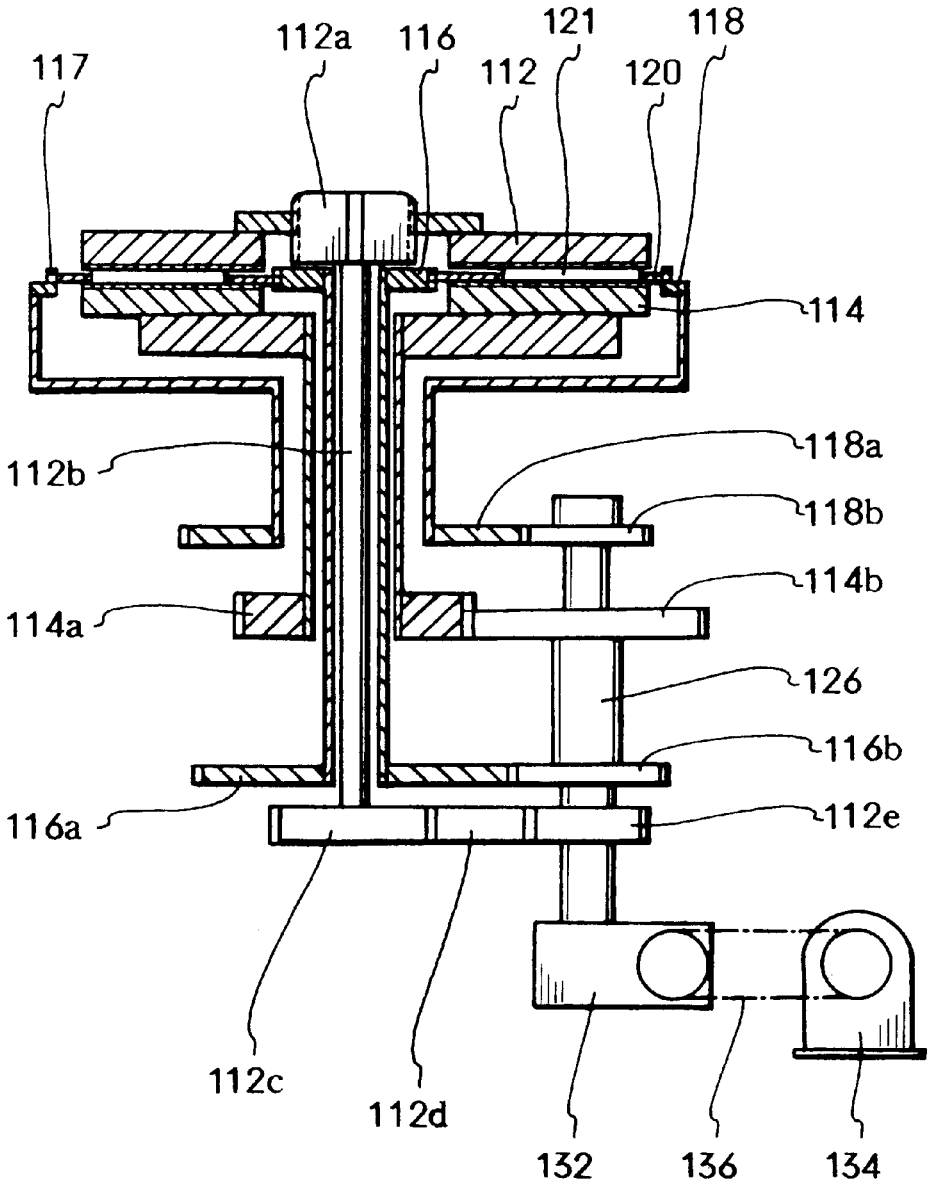
FIG.10 PRIOR ART
FIG. 10 is a sectional view of the conventional polishing machine.
Figure 11:
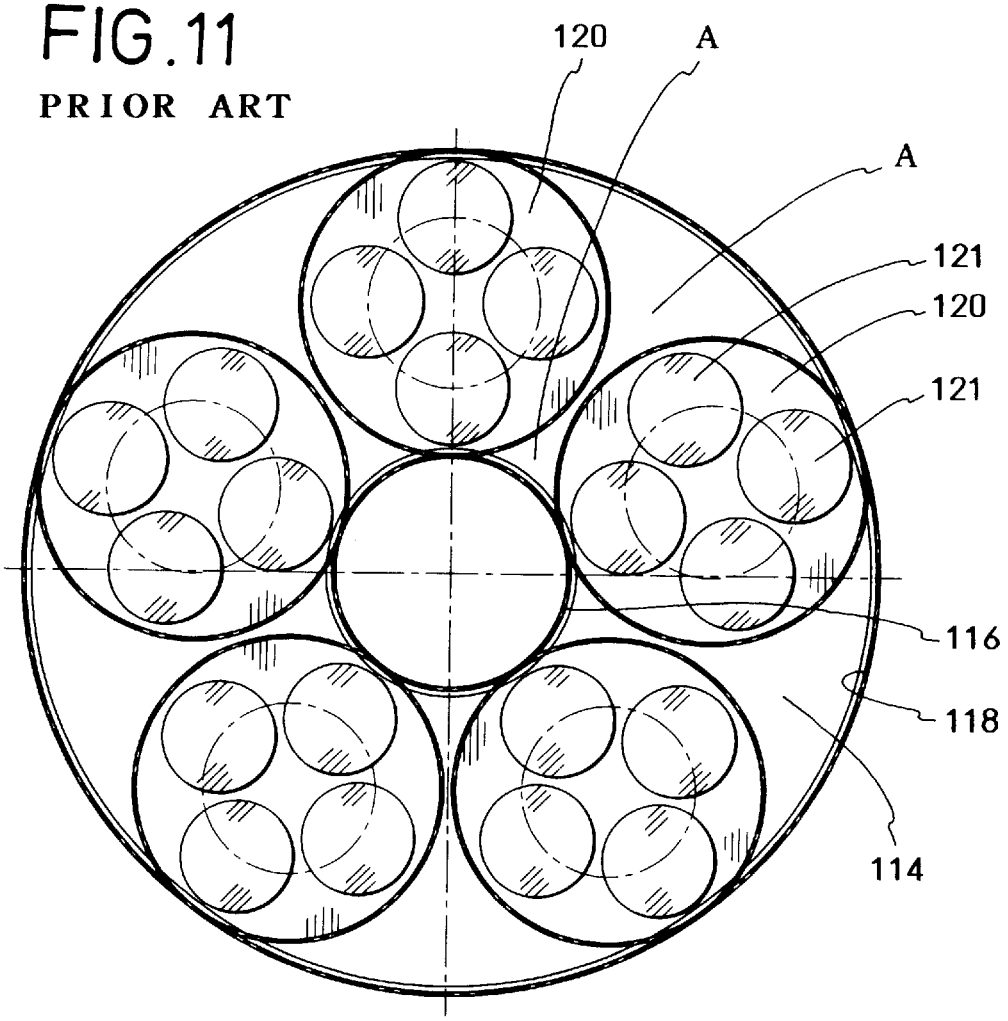
FIG. 11 PRIOR ART
FIG. 11 is a plan view of the carriers.

Successively, a load restraining mechanism of the upper polishing plate 14 will be explained with reference to FIGS. 9A and 9B. FIG. 9A is the plan view of the load restraining mechanism; FIG. 9B is the side view thereof.

A spindle 90 having enough toughness is vertically arranged and capable of rotating. A lower end of the spindle 90 is fixed to the upper face of the upper polishing plate 14 to suspend and rotate the polishing plate 14 as the rotary shaft. The spindle 90 is rotatable attached to an elevating member 94 with a bearing 92. A driving unit for rotating the spindle 90 is built in the elevating member 94. The elevating member 94 is capable of vertically reciprocatively moving along a guide section 96, which is upwardly extended from the base member 30. The upper polishing plate 14 is tightly fixed to the lower end of the spindle 90 by a cone member 91.

By the spindle 90, the upper polishing member 14 can be always maintained parallel to the lower polishing plate 16, so that the polishing accuracy can be improved. In the embodiment shown in FIG. 6, the carrier 12 is moved round the axial line of the upper polishing plate 14, so the polishing face of the upper polishing plate 12 cannot contact the wafers, and the upper polishing plate 14 is capable of inclining to make parallel to the lower polishing plate 16. However, load of the upper polishing plate 14 cannot be uniformly applied to the wafers 10 due to the inclination. On the other hand, in the polishing machine having the load restraining mechanism, the upper polishing plate 14 can be always maintained parallel to the lower polishing plate 16 by the enough toughness of the spindle 90, so that the load of the upper polishing plate 14*c* an be uniformly applied to the wafers 10 and the polishing accuracy can be improved.

When the wafers 10 are set in and taken out and when the polishing cloths are exchanged, an upper part 5, which includes the upper polishing plate 14, the spindle 90, etc., is vertically moved, in the direction "G" shown in FIG. 9(B), together with the elevating member 94, by a driving unit (not shown). In this case, the upper part 5 may be shifted sideward instead of the vertical movement.

Since the upper part 95 can be vertically moved together with the elevating member 94, the spindle 90 (the rotary shaft) can be shorter than the spindle 72 shown in FIG. 6. A part between the lower end of the bearing 92 and the upper polishing plate 12, which is downwardly projected from the elevating member 95, can be made as short as possible, and the upper polishing plate 12 can be held securely. Thus, the toughness of the upper polishing plate 14 can be greater, and the upper polishing plate 14 can be always maintained parallel to the lower polishing plate 16. And, the load of the upper polishing plate 14 can be uniformly applied to the wafers 10, so that the polishing accuracy can be improved.

An example of operating the polishing machine will be explained.

Firstly, in the case of rotating the polishing plates 14 and 16, in the opposite directions, at the same rotational speed. For example, as shown in FIG. 1, the upper polishing plate 14 is rotated in the clockwise direction; the lower polishing plate 16 is rotated in the counterclockwise direction. In this case, the frictional force between the upper polishing plate 14 and the wafers 10 and the frictional force between the lower polishing plate 16 and the wafers 10 work in the opposite directions. Thus, the frictional forces are mutually canceled, so that the wafers 10 are standstill and their both faces are polished. However, in the polishing plates 14 and 16, the moving speed at outer edges are faster than that at centers. Thus, parts of the wafers 10, which are separated away from the axial line "L" of the polishing plates 14 and 16, are much polished, namely the wafers 10 cannot be polished uniformly.

Next, the case of moving the carrier 12 along the circular orbit without revolving its own axis will be explained.

While the carrier 12 is moved along the circular orbit without revolving, all the points in the carrier 12 execute the same movement. The all points in the carrier 12 repeat the same movement, and their total movement becomes the circular orbital movement.

By moving the carrier 12, together with the wafers 10, along the circular orbit without revolving, the both faces of the wafers 10 can be polished uniformly.

The wafers 10 are rotatably accommodated in the through-holes 12*a*. When the rotation of the polishing plates 14 and 16 are combined with the circular orbital movement of the carrier 12, if the rotational speed of the polishing plates 14 and 16 are different, the rotational directions of the wafers 10 and the rotational direction of the faster polishing plate are the same. Namely, the wafers 10 can be rotated in the prescribed direction by adjusting the difference of the rotational speed of the polishing plates.

By rotating or revolving the wafers 10 on their own axes, the disadvantage caused by the difference of the moving speed in the polishing plates 14 and 16 can be solved, and the wafers 10 can be polished uniformly.

To uniformly polish the both faces of each wafer 10, the rotational speed of the upper polishing plate 14 and the lower polishing plate 16 are controlled to alternately make the rotational speed of the one faster than that of the other.

Next, another embodiment will be explained.

In the foregoing embodiments, the carrier 12 has a plurality of the through-holes 12*a* and a plurality of the work pieces, e.g., the wafers 10, are simultaneously polished. In the case of polishing a large work piece, one large through-hole 12*a* may be formed in the carrier 12. Note that, examples of the large work piece are a rectangular glass plate for a liquid crystal display unit. And, the present invention may be applied to the polishing machine for polishing one work piece, e.g., one wafer.

In the case of polishing the large work piece whose size is slightly smaller than that of the carrier 12, the large work piece is mainly polished by moving the carrier 12 along the circular orbit without revolving on its oxis; the upper polishing plate 14 and the lower polishing plate 16 are rotated at lower speed, which causes no irregular polishing. With this manner, the both faces of the large wafer can be uniformly polished. In the upper polishing plate 14 and the lower polishing plates 16, the moving speed at the outer edges of theirs are faster than that at centers thereof, so the outer part of the large work piece is much polished. If the rotational speed of the upper polishing plate 14 and the lower polishing plates 16 are fully slower than the speed of the orbital movement of the carrier 12, the rotation of the upper polishing plate 14 and the lower polishing plates 16 do not cause the irregular polishing. But, by rotating the upper polishing plate 14 and the lower polishing plates 16, contact parts of the polishing plates 14 and 16, which contact the both faces of the work piece, can be changed, and the slurry can be supplied on the whole faces of the work piece.

In the above described embodiments, the present invention is applied to the polishing machine, but it can be applied to a lapping machine.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A polishing machine, comprising:

a carrier being formed as a plate, said carrier having a through-hole in which a work piece is accommodated;

an upper polishing plate being provided on an upper side of said carrier, said upper polishing plate polishing an upper face of the work piece in the through-hole of said carrier;

a lower polishing plate being provided on a lower side of said carrier, said lower polishing plate pinching the work piece with said upper polishing plate and polishing a lower face of the work piece;

a carrier holder presenting a ring shape defining an inner space, said carrier holder holding said carrier in said inner space; and a driving mechanism for moving said carrier along a circular orbit in a plane, which is parallel to upper and lower faces of said carrier, without revolving, so as to move the work piece, which has been pinched between said polishing plates, along the circular orbit and polish the upper and lower faces of the work piece by said polishing plates.

2. The polishing machine according to claim 1, wherein said upper and lower polishing plates are revolved on their own axes, which are perpendicular to the upper and lower faces of said carrier.

3. The polishing machine according to claim 1, wherein said carrier holder and said carrier are connected by a connecting mechanism, which allows heat expansion of said carrier by a clearance.

4. The polishing machine according to claim 3, wherein said connecting mechanism is a pin provided to said carrier holder, said pin is loosely fitting in a hole, which is formed in said carrier and elongated in the direction of the heat expansion of said carrier.

5. The polishing machine according to claim 1, wherein said upper polishing plate has a feeding hole through which a liquid abrasive is fed to a polishing face of said upper polishing plate, which polishes the work piece, and wherein said carrier has a connecting hole through which the liquid abrasive, which has been fed through said feeding hole, is fed to a polishing face of said lower polishing plate, which polishes the work piece.

6. The polishing machine according to claim 5, wherein said carrier has a connecting hole through which the liquid abrasive, which has been fed through said feeding hole, is fed to a polishing face of said lower polishing plate, which polishes the work piece.

7. A polishing machine comprising:

a carrier being formed as a plate, said carrier having a through-hole in which a work piece is accommodated;

an upper polishing plate being provided on an upper side of said carrier, said upper polishing plate polishing an upper face of the work piece in the through-hole of said carrier;

a lower polishing plate being provided on a lower side of said carrier, said lower polishing plate pinching the work piece with said upper polishing plate and polishing a lower face of the work piece; and a driving mechanism for moving said carrier along a circular orbit in a plane, which is parallel to upper and lower faces of said carrier, without revolving, such that the upper and lower faces of the work piece, which has been pinched between said polishing plates, are polished by said polishing plates, wherein said driving mechanism includes:

a base member;

a carrier holder for holding said carrier;

a crank-shaped member including a first shaft, which is arranged perpendicular to the upper and lower faces of said carrier and whose one end is pivotably connected to said carrier holder, and a second shaft, which is arranged in parallel to the first shaft and whose one end is pivotably connected to said base member; and a rotating unit for rotating the second shaft of said crank-shaped member on its own axis, such that the first shaft of said crank-shaped member is moved round and said carrier holder is moved along a circular orbit without revolving.

8. The polishing machine according to claim 7, wherein a plurality of said crank-shaped members are provided, and their second shafts are mutually connected by a synchronizing mechanism, which synchronously moves said crank-shaped members.

9. A polishing machine, comprising:

a carrier being formed as a plate, said carrier having a through-hole in which a work piece is accommodated;

an upper polishing plate being provided on an upper side of said carrier, said upper polishing plate polishing an upper face of the work piece in the through-hole of said carrier;

a lower polishing plate being provided on a lower side of said carrier, said lower polishing plate pinching the work piece with said upper polishing plate and polishing a lower face of the work piece;

a driving mechanism for moving said carrier along a circular orbit in a plane, which is parallel to upper and lower faces of said carrier, without revolving, such that the upper and lower faces of the work piece, which has been pinched between said polishing plates, are polished by said polishing plates; and a vibration restraining mechanism capable of contacting said upper polishing plate so as to restrain vibration of said upper polishing plate in the direction parallel to the upper and lower faces of said carrier.

10. The polishing machine according to claim 9, wherein said vibration restraining mechanism includes guide rollers, which contact an outer circumferential face of said upper polishing plate.

11. A polishing machine, comprising:

a carrier being formed as a plate, said carrier having a through-hole in which a work piece is accommodated;

an upper polishing plate being provided on an upper side of said carrier, said upper polishing plate polishing an upper face of the work piece in the through-hole of said carrier;

a lower polishing plate being provided on a lower side of said carrier, said lower polishing plate pinching the work piece with said upper polishing plate and polishing a lower face of the work piece;

a driving mechanism for moving said carrier along a circular orbit in a plane, which is parallel to upper and lower faces of said carrier, without revolving, such that the upper and lower faces of the work piece, which has been pinched between said polishing plates, are polished by said polishing plates;

a rotary shaft being arranged in the direction perpendicular to the upper and lower faces of said carrier, said rotary shaft being revolved on its own axis, one end of said rotary shaft being fixed to said upper polishing plate to suspend and revolve said upper polishing plate; and an elevating member holding said rotary shaft, said elevating member being capable of vertically moving together with said rotary shaft, such that polishing faces of said upper polishing plate and said lower polishing plate are maintained parallel, and load of said upper polishing plate is uniformly applied to said work piece.

* * * * *